US006674242B2

(12) United States Patent
Kastalsky et al.

(10) Patent No.: US 6,674,242 B2
(45) Date of Patent: Jan. 6, 2004

(54) FIELD-EMISSION MATRIX DISPLAY BASED ON ELECTRON REFLECTIONS

(75) Inventors: Alexander Kastalsky, Wayside, NJ (US); Sergey Shokhor, Sound Beach, NY (US); Frank J. DiSanto, North Hills, NY (US); Denis A. Krusos, Lloyd Harbor, NY (US); Boris Gorfinkel, Saratov (RU); Nikolai Abanshin, Saratov (RU)

(73) Assignee: Copytele, Inc., Melville, NY (US)

( * ) Notice: Subject to any disclaimer, the term of this patent is extended or adjusted under 35 U.S.C. 154(b) by 0 days.

(21) Appl. No.: 10/102,450

(22) Filed: Mar. 20, 2002

(65) Prior Publication Data

US 2002/0149322 A1 Oct. 17, 2002

Related U.S. Application Data

(60) Provisional application No. 60/277,171, filed on Mar. 20, 2001, provisional application No. 60/284,864, filed on Apr. 19, 2001, and provisional application No. 60/355,683, filed on Feb. 7, 2002.

(51) Int. Cl.[7] ..... G09G 3/10

(52) U.S. Cl. ..... 315/169.3; 313/495

(58) Field of Search ..... 315/169.1, 169.3, 315/209 R; 313/498, 503, 504, 505, 506, 495, 496

(56) References Cited

U.S. PATENT DOCUMENTS

| | | | | |
|---|---|---|---|---|
| 5,192,240 A | | 3/1993 | Komatsu | 445/24 |
| 5,214,347 A | | 5/1993 | Gray | 313/355 |
| 5,229,626 A | * | 7/1993 | Ebitani et al. | 257/84 |
| 5,382,867 A | | 1/1995 | Yuji et al. | 313/309 |
| 5,528,099 A | | 6/1996 | Xie et al. | 313/309 |
| 5,552,679 A | * | 9/1996 | Murasko | 315/169.3 |
| 5,742,129 A | * | 4/1998 | Nagayama et al. | 315/167 |
| 5,965,971 A | | 10/1999 | Karpov | 313/309 |
| 6,023,126 A | | 2/2000 | Karpov | 313/310 |
| 6,445,122 B1 | * | 9/2002 | Chuang et al. | 313/495 |
| 6,541,908 B1 | * | 4/2003 | Cheung et al. | 313/503 |
| 6,554,671 B1 | * | 4/2003 | Hofmann et al. | 445/24 |

FOREIGN PATENT DOCUMENTS

| | | |
|---|---|---|
| RU | 2022393 | 10/1994 |
| RU | 2075130 | 3/1997 |
| RU | 208960 | 9/1997 |
| RU | 2097869 | 11/1997 |

* cited by examiner

*Primary Examiner*—Don Wong
*Assistant Examiner*—Jimmy T Vu
(74) *Attorney, Agent, or Firm*—Duane Morris LLP

(57) ABSTRACT

A Reflective Field Emission Display (FED) system using reflective field emission pixel elements is disclosed. In the FED system disclosed, each pixel elements is composed of at least one edge emitter that is operable to emit electrons and at least one reflector that is operable to first attract and then reflect the emitted electrons onto a transparent layer that is operable to attract the reflected electrons. The transparent anode layer is oppositely positioned with respect to the cathode or emitter edge. In a one aspect of the invention, a phosphor layer interposed between the transparent layer and the pixel element produces a light photon as reflected electrons are attracted to the transparent layer. In another aspect of the invention, a plurality of phosphor layers are applied to the transparent layer to produce a color display when reflected electrons are attracted to the transparent layer.

52 Claims, 5 Drawing Sheets

FIELD-EMISSION MATRIX DISPLAY BASED ON ELECTRON REFLECTIONS

PRIORITY FILING DATE

This application claims the benefit of the earlier filing date, under 35 U.S.C. §119, of U.S. Provisional Patent Applications;

Ser. No. 60/277,171, entitled "New Edge-Emission Matrix Display," filed on Mar. 20, 2001;

Ser. No. 60/284,864, entitled "Field-Emission Matrix Display Based on Electron Reflections," filed on Apr. 19, 2001; and Ser. No. 60/355,683, entitled, "New Features in Edge Emitter Field Emission Display", filed on Feb. 7, 2002, of which are incorporated by reference herein.

RELATED APPLICATIONS

This application relates to commonly assigned patent applications:

Ser. No. 10.102,467 entitled "Field-Emission Matrix Display Based on Lateral Electron Reflection," filed on Mar. 20, 2002; and Ser. No. 10/102,467 entitled "Improved Method for Fabricating Edge Emitter Field Emission Displays," filed on Mar. 20, 2002, the disclosures of which are incorporated by reference herein.

FIELD OF THE INVENTION

The present invention relates to solid-state displays and more specifically to edge-emitter reflective field emission pixel elements of solid-state displays.

BACKGROUND OF THE INVENTION

Solid state and non-Cathode Ray Tube (CRT) display technologies are well-known in the art. Light Emitting Diode (LED) displays, for example, include semiconductor diode elements that may be arranged in configurations to display alphanumeric characters. Alphanumeric characters are then displayed by applying a potential or voltage to specific elements within the configuration. Liquid Crystal Displays (LCD) are composed of a liquid crystal material sandwiched between two sheets of a polarizing material. When a voltage is applied to the sandwiched materials, the liquid crystal material aligns in a manner to pass or block light. Plasma displays conventionally use a neon/xenon gas mixture housed between sealed glass plates that have parallel electrodes deposited on the surface.

Passive matrix displays and active matrix displays are flat panel displays that are used extensively in laptop and notebook computers. In a passive matrix display, there is a matrix or grid of solid-state elements in which each element or pixel is selected by applying a potential to a corresponding row and column line that forms the matrix or grid. In an active matrix display, each pixel is further controlled by at least one transistor and a capacitor that is also selected by applying a potential to a corresponding row and column line. Active matrix displays provide better resolution than passive matrix displays, but they are considerably more expensive to produce.

While each of these display technologies has advantages, such as low power and lightweight, they also have characteristics that make them unsuitable for many other types of applications. Passive matrix displays have limited resolution, while active matrix displays are expensive to manufacture.

Hence, there is a need for a low-cost, lightweight, high-resolution display that can be used in a variety of display applications.

SUMMARY OF THE INVENTION

A Field Emission Display (FED) device using edge-emitter reflective field emission pixel elements is disclosed. In the FED device disclosed, each pixel element comprises at least one cathode or edge emitter that is operable to emit electrons and at least one reflector that is operable to attract and reflect the emitted electrons. A transparent layer is oppositely positioned to the cathode or emitter and is operable to attract the reflected electrons. A phosphor layer is interposed between the transparent layer and the emitter/reflector elements and produces a photonic response as reflected electrons are attracted to the transparent layer and bombard the phosphor layer. In another aspect of the invention, a plurality of phosphor layers are applied to the transparent layer, which produce different levels of color as reflected electrons are attracted to the transparent layer and bombard corresponding phosphor layers.

Figure 1A:
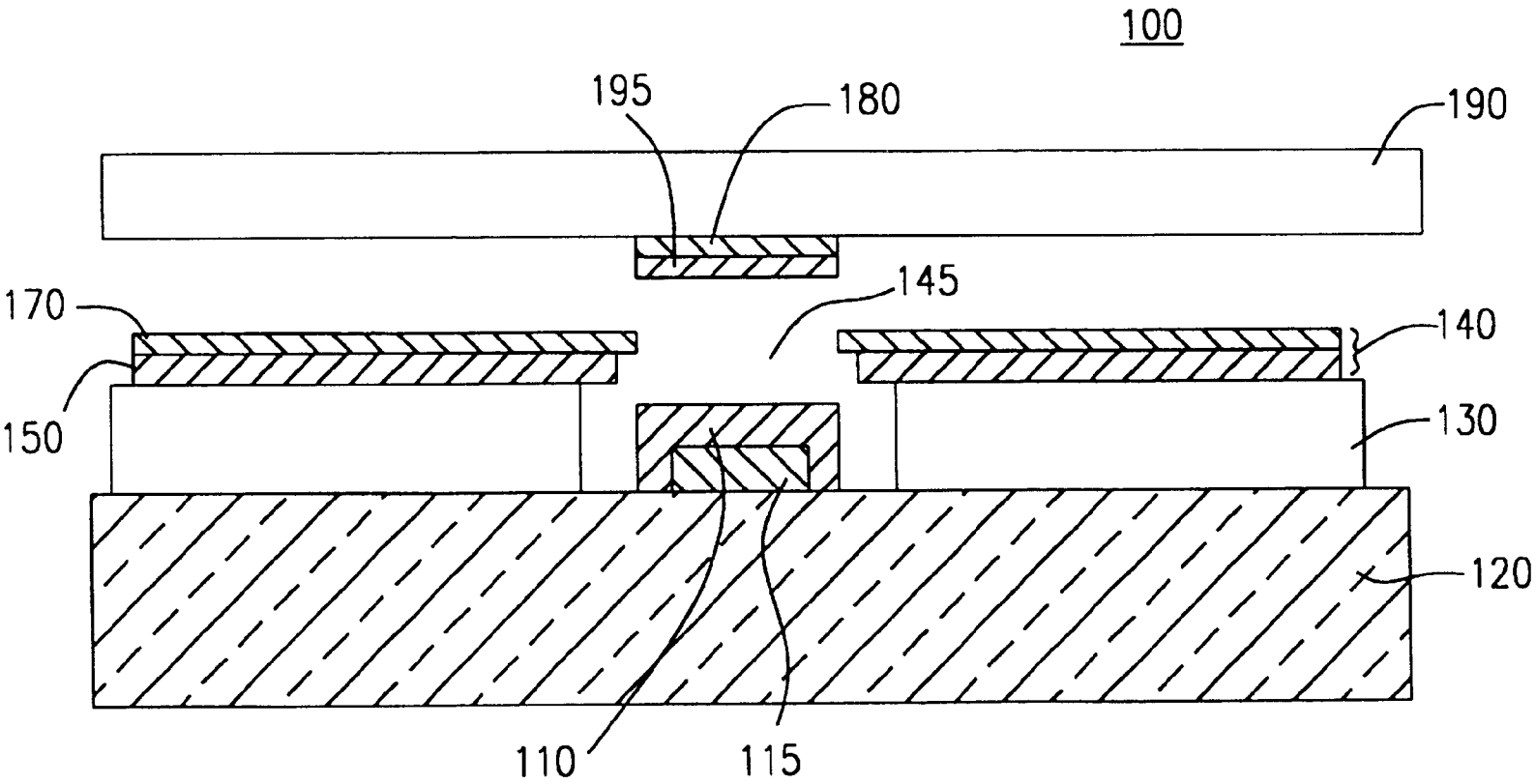
FIG. 1*a* illustrates a cross-sectional view of a first embodiment of a Field-Emission Display (FED) pixel element in accordance with the principles of the invention.

It is to be understood that these drawings are solely for purposes of illustrating the concepts of the invention and are not intended as a definition of the limits of the invention. It will be appreciated that the same reference numerals, possibly supplemented with reference characters where appropriate, have been used throughout to identify corresponding parts.

DETAILED DESCRIPTION OF THE INVENTION

FIG. 1*a* illustrates a cross-sectional view of a Edge-Emitter Field Emission Display (FED) pixel 100 in accordance with the principles of the invention. In this exemplary embodiment, pixel element 100 is fabricated by depositing at least one conductive layer 115 on substrate 120, e.g. glass. Conductive layer 115 is representative of an electrode that is used to control a voltage applied to pixel elements 100 that are arranged in columns. Conductive line 115 may be any material possessing a high electrical conductivity selected from a group of metals, such as, aluminum, chromium molybdenum, etc. In a preferred embodiment, conductive layer 115 is formed from chromium.

Insulator layer 130, preferrably silicon dioxide, $SiO_2$, is next deposited on conductive layer 115. Insulator layer 130 electrically isolates conductive layer 115 and is preferably in the range of about 0.5 microns thick. Emitter layer 140 is then deposited on insulating layer 130. Emitter layer 140 is comprised preferably of a bottom conductive layer 150 and edge emitter layer 170. Conductive layer 150 is representative of a material to provide an electrical contact to the edge emitter 170. Emitter or cathode layer 170 is made preferably from an alpha-carbon (α-C) material. Cathode 170 is formed as an edge of a 50–80 nanometer-thick alpha-carbon thin film. Alpha-carbon film is well known to have a low work function for electron emission into a vacuum. In another aspect of the invention, a resistive material, such as alpha-silicon (α-Si), may be imposed between conductive layer 160 and emitter edge 170.

Pixel well 145 is next created by etching, for example, using photo-resistant patterning, through emitter layer 140 and insulator film layer 130 to expose conductive layer 115.

Reflector layer 110 is then deposited on exposed conductive layer 115 using known self-aligning metal deposition techniques. In this case, the width of reflector layer 110 is substantially equal to the distance between emitter layer 170 edges. Reflector layer or element 110 may be any material possessing a high electrical conductivity and a high electron reflection efficiency, such as, aluminum, chromium molybdenum, etc. In a preferred embodiment, aluminum (Al) is selected as reflector layer 110. As will be appreciated, reflector element 110 may be used to control the voltage applied to cathode 140, and consequently the flow of electrons from emitter edge 170. In another aspect, without self-aligned reflective layer 110, conductive layer 115 serves as a reflector.

A transparent electrode (ITO) 180 is deposited on transparent plate 190, e.g., glass. ITO layer 180 is an optically transparent conductive material, which may be used to provide a known potential in selective areas of ITO 180.

A phosphor layer 195 is next deposited on ITO 180. Phosphor layer 195 produces a predetermined or desired level of photonic activity or illumination when activated or bombarded by an impinging electron. In a preferred aspect, phosphor layer is deposited such that it is opposite a corresponding pixel well 145.

Glass plate or transparent substrate 190 is separated from the emitter edge element 170 by a small distance, preferably in the range of 100–200 microns. The small separation distance prevents any significant broadening of the reflected electron beam. Hence, a small spot of phosphor luminescence and consequently, good display resolution are achieved. Furthermore, the small separation distance prevents the development of multiple electron reflections on top glass 190. Although not shown, it would be appreciated that a dielectric material, such as $SiO_2$, separates transparent substrate 190 and emitter element 170.

In the operation of the FED pixel element 100, the application of a positive voltage to conductive layer 115 relative to emitter 150 creates an electrical field that draws electrons from emitter layer 150 to reflective layer 110. Electrons reflected from reflective layer 110 are then attracted to a positive voltage applied to ITO layer 180 that bombard phosphor layer 195.

In another aspect of the invention, ITO layer 180 may be formed into electrically isolated conductive stripes arranged in columns, orthogonal to pixel elements formed in rows, as will be further explained. In this aspect, a high constant voltage may be applied to selected electrically conductive lines within ITO layer 180 such that electrons, emitted from selected emitter edges 170 and reflected from reflector layer 110 are attracted to selected conductive lines on ITO 180. Selective control line activation on the ITO layer 180 is advantageous when different color phosphors are used, as in a color display.

As will be appreciated, the gap between the emitter edge 170 and reflector layer 110 can be made extremely small, preferably less than or equal to one (1) micron. In this case, the voltage difference between emitter edge 170 and reflector 110 can be reduced to a level between 30 and 100 volts. The potential of the combined phosphor/ITO 180 is kept at a significantly higher voltage, typically a few hundred volts to attract reflected electrons to corresponding phosphor layers.

Figure 1B:
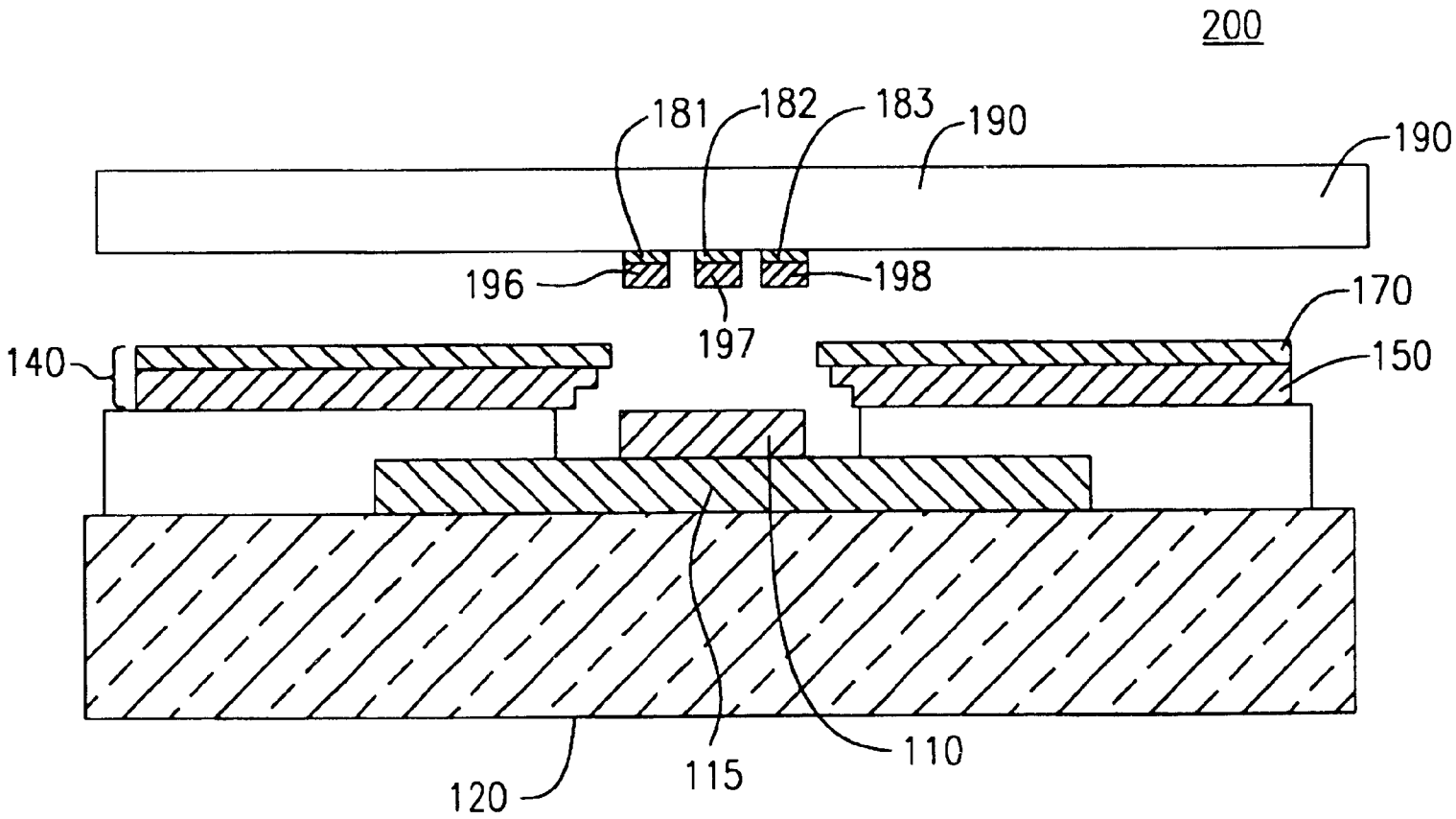
FIG. 1*b* illustrates a cross-sectional view of a second embodiment of an FED pixel element in accordance with the principles of the invention.

FIG. 1*b* illustrates a second embodiment of an FED 200 in accordance with the principles of the invention. In this second embodiment, a plurality of phosphor layers represented as 196, 197, 198 are adjacently deposited onto ITO layer 180 for each pixel element. In a preferred embodiment phosphor layers 196, 197, 198, emit a visible light in a band corresponding to one of the primary colors, i.e., red, green, blue. As would be appreciated the selection of colors and the order of the color phosphor layers may be exchanged without altering the scope of the invention.

In this second embodiment of the invention, light emission control is accomplished by applying a high voltage to selective areas of ITO layer 180, as previously discussed, wherein each selected area corresponds to one of each phosphor layer. In this aspect, different levels of high voltage may be applied to selective areas of ITO layer 180 to attract different amounts of reflected electrons to a corresponding phosphor layer to produce desired levels of color emission.

Figure 2:
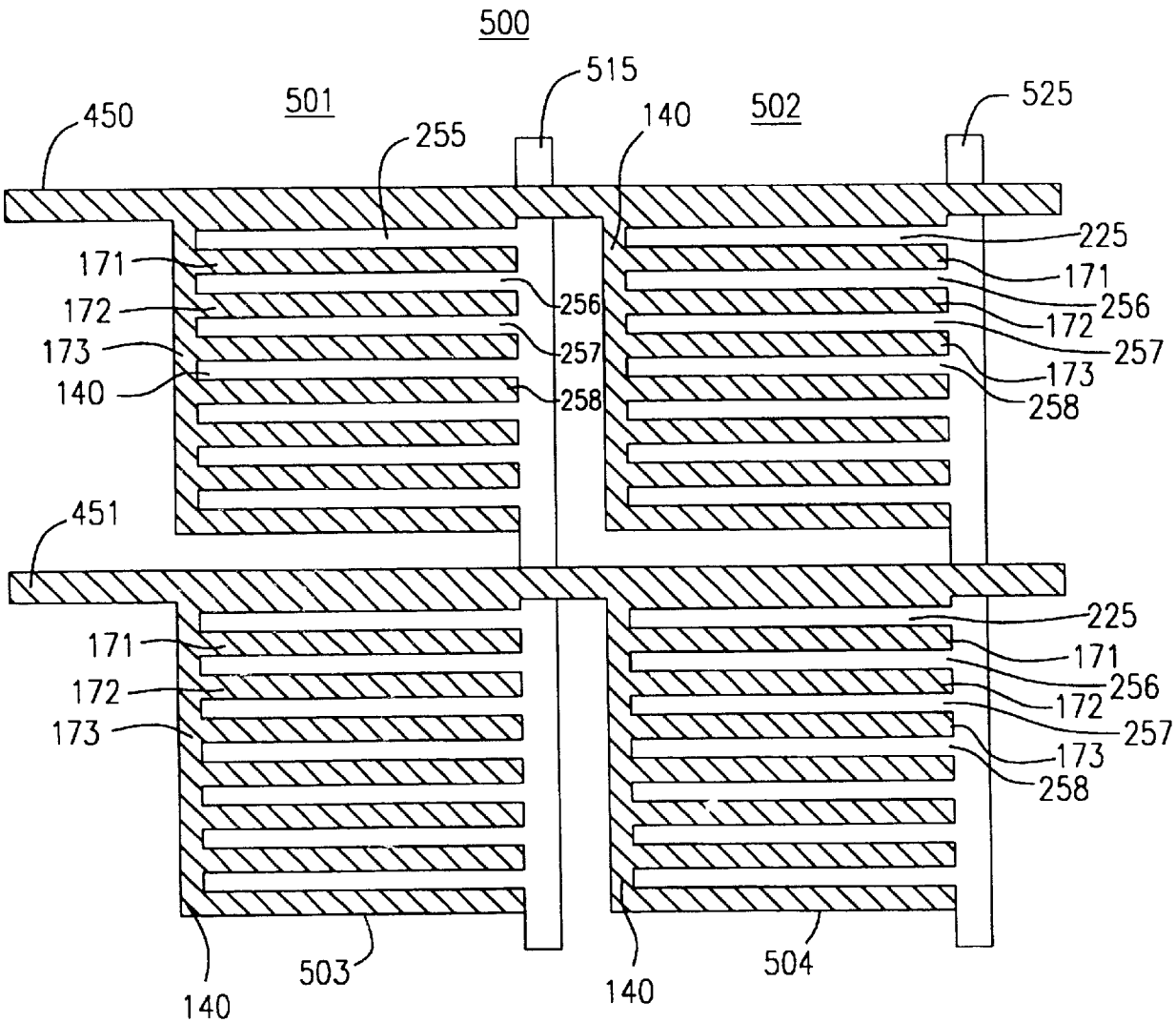
FIG. 2 illustrates a top view of an FED display of two rows and columns using the pixel elements illustrated in FIG. 1*b;*

FIG. 2 illustrates a top view of preferred embodiment of a FED display 500 containing four FED reflective pixel elements in accordance with the principles of the present invention. In this embodiment, cathodes or emitters 140 of pixel elements 501, 502 are connected in a single row 450 and the cathodes or emitters 140 of pixel elements 503, 504 are connected a second row 451. Furthermore, the reflective layers 110 of pixel elements 501, 503 are connected in a single column 515, while the reflective layers 110 of pixel element 502, 504 are connected in a second column 525.

Also illustrated in this preferred embodiment is emitter 140 distributed throughout a corresponding pixel area 145 as a "comb" having a plurality of tangs, prongs, fingers or digits, represented as digits 171, 172, 173. In this manner, the length of emitter layer 140, and consequentially emitter layer 170 edge is substantially increased. Similarly, reflective layer 110 is also distributed throughout pixel area 145 as a comb having a plurality of tangs, prongs, fingers or digits, 255, 256, 257, 258. In this illustrated preferred embodiment, reflective layer 110 digits 255, 256, 257, 258 are interlocked with or fitting between corresponding emitter digits. As will be appreciated, emitter 140 digits 171, 172, 173 and reflective layer 110 digits 255, 256, 257, 258 are vertically disposed and offset from each other.

Figure 3:
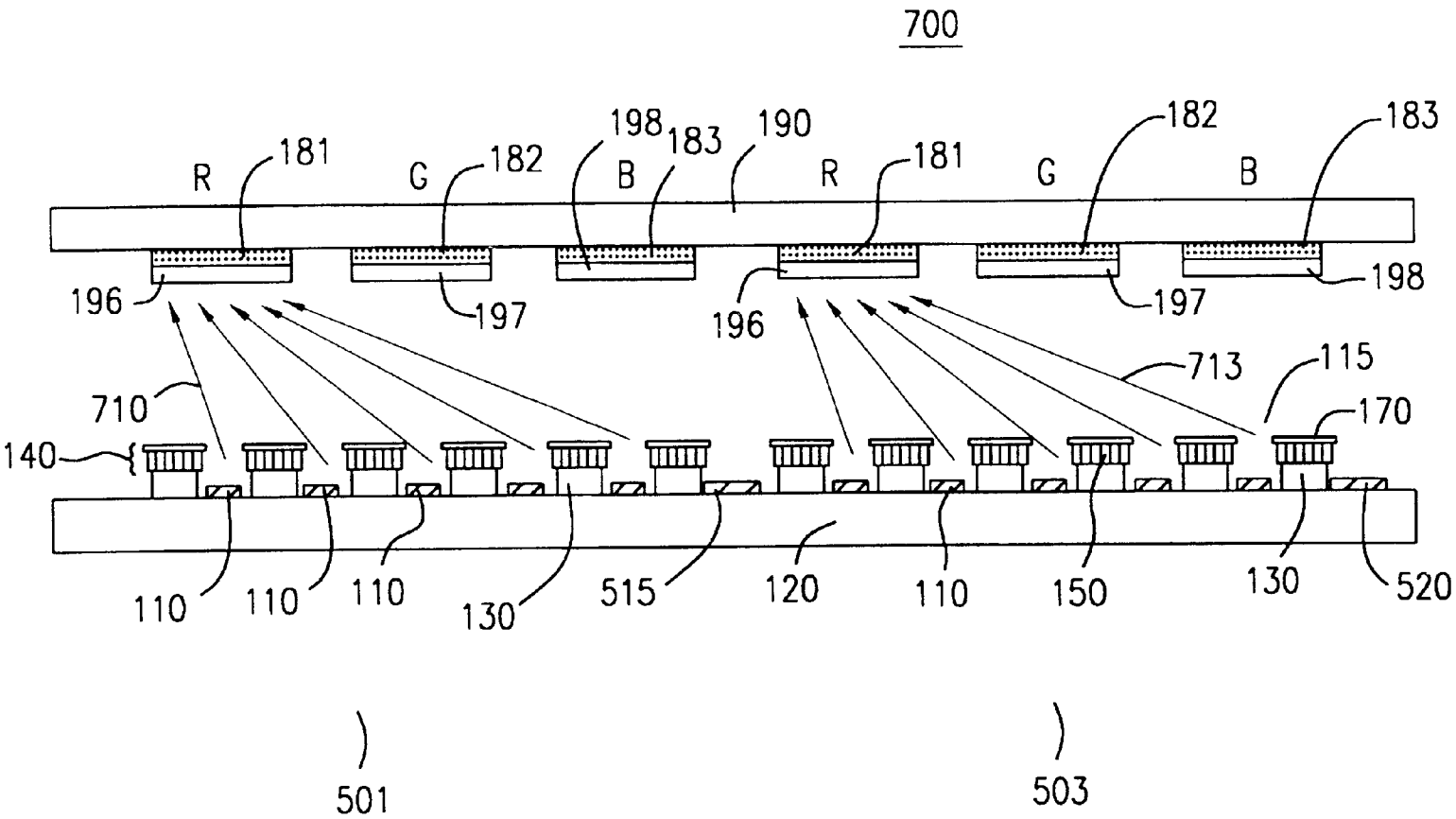
FIG. 3 illustrates a cross sectional view of FED display shown in FIG. 2.

FIG. 3 illustrates a cross-sectional view of pixel elements 501, 502 in row 450 shown in FIG. 2. In this illustrated cross-sectional view, reflector layer 110 is shown interlockedly interposed between cathode or emitter layer 140 of pixel 501 and 502. Also illustrated are columns 515 and 520 adjacent to pixel 501 and 503, respectively, which are used to apply a voltage to an associated reflective layer 110. On transparent layer 190 is shown phosphor layers 196, 197, and 198 associated with each pixel element. As previously discussed, reflected electrons may be drawn to selected phosphor layers, for example phosphor layer 196, by selectively applying a high voltage to corresponding ITO layer 181.

In one aspect of the invention, voltages may be alternatively applied to each ITO layer 181, 182, 183, in a sequential manner for a fixed duration of time related to a frame time. For example, a voltage is applied as illustrated to a single ITO layer 181, while a low or no voltage is applied to other ITO layers, i.e., 182, 183, in a each corresponding pixel. Hence, electrons are drawn to a single phosphor layer, as illustrated. In a preferred embodiment, voltage is sequentially applied to each ITO layer for one-third ($1/3^{rd}$) of the display frame time. Time-sequential application of voltage is advantageous as the number of drivers is reduced while beam-spreading and pixel cross-talk in the row direction is reduced.

Figure 4A:
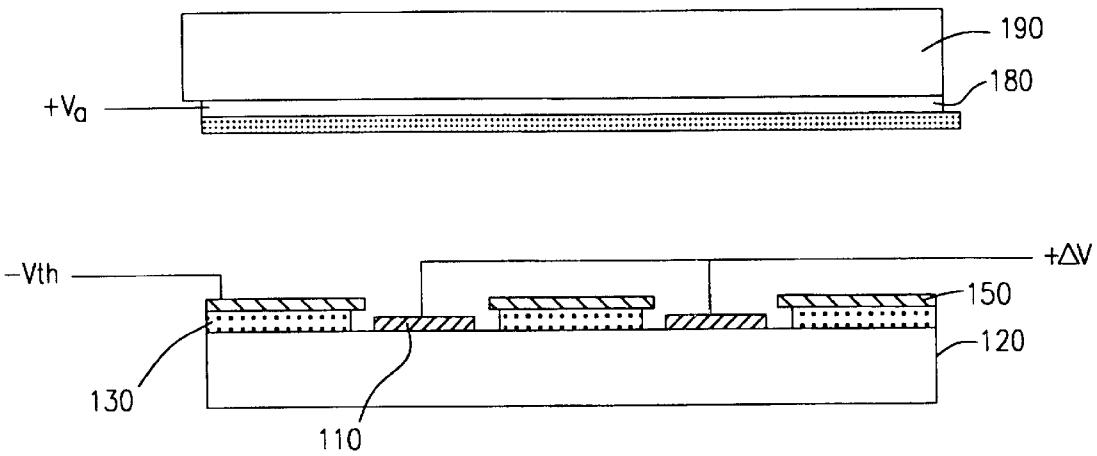
FIGS. 4*a* and 4*b* illustrate the power supply connection and operational conditions of the FED pixel shown in FIG. 1*a.*
Figure 4B:
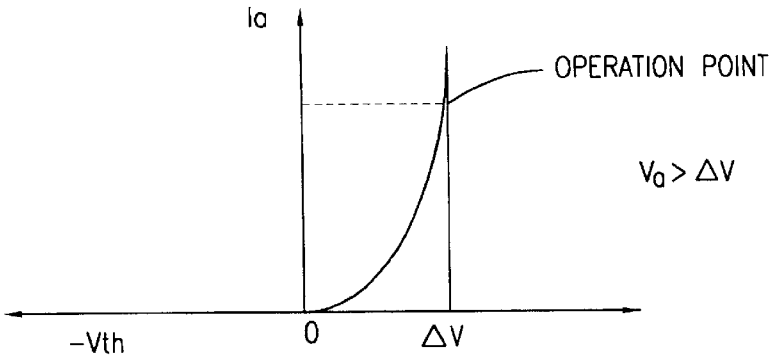

FIGS. 4*a* illustrates the voltage connections and operating conditions of the FED element in accordance with the principles of the present invention. FIG. 4*b* illustrates that the field emission current posses an extremely sharp field dependence and a pronounced emission threshold. Thus, it is possible to sub-divide the total cathode-reflector voltage difference into a constant voltage Vo and a variable voltage ΔV, which may be pulsed. Constant voltage Vo may be applied to the emitter as a negative voltage or a zero voltage, which may indicate a particular row is not activated. A positive variable voltage ΔV may then be applied to reflector 110 to activate the emission at the row-column intersection. Furthermore, a zero voltage as a column voltage corresponds to the non-activated pixel. Hence, a pixel is in its on-state when a negative voltage Vo relative to the reflector is applied to the row containing emitter 140 and a positive ΔV voltage is applied to the column containing reflector 110.

As is well known in the art, masking for example, using photo-resistance masks is accomplished over that portion of the metal that is not to be removed, while maintaining expose the unwanted portion. The exposed portion is then removed by subjecting the multi-layer structure to a metal etching process. There are several different etching processes available to those skilled in the art. Furthermore, the term "deposited" as used in this written description includes means for forming or growing on a material layer on a surface by exposing the surface to the material. Vapor deposition, thermal growth, oxidation and sputtering are examples of deposition processes that can be used in accordance with the principles of the present invention.

As would be understood by those skilled in the art, a sold-state flat panel display using laterally reflected pixel elements disclosed herein may be formed by arranging a plurality of pixel elements, for example, pixel 100, emitter layers 140 electrically connected in rows and reflector layers 110 and 310 are arranged in columns. Pixel elements may then be selected to produce an image viewable through transparent layer 185 by the application of voltages to selected rows and columns. Control of selected rows and columns may be performed by any means, for example, a processor, through appropriate row controller circuitry and column controller circuitry. As will be appreciated, a processor may be any means, such as a general purpose or special purpose computing system, or may be a hardware configuration, such as a dedicated logic circuit, integrated circuit, Programmable Array Logic, Application Specific Integrated circuit that provides known voltage outputs on corresponding row and column lines in response to known inputs.

While there has been shown, described, and pointed out, fundamental novel features of the present invention as applied to preferred embodiments thereof, it will be understood that various omissions and substitutions and changes in the apparatus described, in the form and details of the devices disclosed, and in their operation, may be made by those skilled in the art without departing from the spirit of the present invention. For example, it is expressly intended that all combinations of those elements which perform substantially the same function in substantially the same way to achieve the same results are within the scope of the invention. Substitutions of elements from one described embodiment to another are also fully intended and contemplated.

We claim:

1. A reflective emission pixel comprising:

a substrate layer;

at least one reflective layer, an emitter layer positioned on said substrate layer having an edge for electron emission extending above said at least one reflective layer, wherein said at least one reflective layer is at a first positive potential to attract electrons from said emitter layer;

a transparent electrode layer oppositely positioned, and electrically isolated from, said at least one emitter layer, said transparent electrode layer having a second potential to attract electrons reflected from said at least one reflective layer; and at least one phosphor layer on said transparent electrode layer oppositely positioned to said at least one reflective layer.

2. The pixel as recited in claim 1, further comprising:

a connectivity layer associated with each of said at least one reflective layer, said connectivity layer positioned between said at least one reflective layer and said substrate layer.

3. The pixel as recited in claim 2, wherein said connectivity layer is selected from the group consisting of: chromium, niobium, vanadium, aluminum, molybdenum, gold, silver, copper.

4. The pixel as recited in claim 1, wherein said reflective layer is selected from the group consisting of: aluminum, chromium, niobium, vanadium, gold, silver, copper.

5. The pixel as recited in claim 1, wherein said emitter layer further comprising:

a conductive layer; and a resistive layer in electrical contact with said conductive layer.

6. The pixel as recited in claim 5, wherein said resistive layer is an alpha-carbon material.

7. The pixel as recited in claim 1, wherein said at least one phosphor layer is selected from a group that emits a distinct wavelength when activated.

8. The pixel as recited in claim 7, wherein said distinct wavelength is selected from the group consisting: red, green, blue.

9. The pixel as recited in claim 1, wherein said emitter layer is distributed within said pixel to increase the edge of said emitter layer.

10. The pixel as recited in claim 1, wherein said emitter layer and said at least one reflective layer are each subdivided into a plurality of digits.

11. The pixel as recited in claim 10, wherein said emitter layer digits and said at least one reflective layer digits are interlockingly positioned.

12. The pixel as recited in claim 1, wherein said second potential is selectively applied to selected areas of said transparent electrode layer.

13. The pixel as recited in claim 1, wherein said first potential includes a known constant potential and a potential applied as a pulse.

14. The pixel as recited in claim 12, wherein said second potential is applied sequentially to said selected areas.

15. The pixel as recited in claim 14, wherein said second potential is applied for a known duration.

16. A reflective field edge emission display (FED) system comprising:

a FED display comprising:

a plurality of reflective edge emission pixel elements arranged in a matrix of N rows and M columns, each of said pixel elements containing an emitter element and a reflector element, said reflector element operable to reflect electrons extracted from said emitter element and;

a transparent electrode layer, oppositely positioned to and electrically isolated from said plurality of pixel elements, operable to attract said reflected electrons, at least one phosphor layer deposited on said transparent electrode layer positioned between said transparent electrode layer and said pixel elements;

a row controller operable to apply a known value of a first potential to selected ones of said N rows of associated emitter elements;

a column controller operable to apply a constant portion of said first potential to selected ones of said M columns;

means to select at least one of said N rows and at least one of said M columns; and means to selectively apply a second potential to said transparent electrode layer.

17. The system as recited in claim 16, wherein said at least one phosphor layer is selected from a group that emits a distinct wavelength when activated.

18. The system as recited in claim 17, wherein said distinct wavelength is selected from the group consisting of: red, green, blue.

19. The system as recited in claim 16, wherein said pixel emitter element is distributed within said pixel.

20. The system as recited in claim 16, wherein said pixel element emitter and said associated reflector are subdivided into a plurality of digits.

21. The system as recited in claim 20, wherein said plurality of emitter digits and said plurality of reflector digits are offset and interlockingly positioned.

22. The system as recited in claim 16, wherein said edge emitter further comprises:

a conductive layer; and a resistive layer in electrical contact with said conductive layer.

23. The system as recited in claim 22, wherein said resistive layer is an alpha-carbon material.

24. The system as recited in claim 16, wherein said second potential is applied in a sequential manner.

25. The system as recited in claim 24, wherein said second potential is applied for a known period of time.

26. A method for fabricating a reflective FED pixel element comprising the steps of:

depositing on a first substrate;

at least one reflective layer having a high efficiency of electron reflection;

an insulating layer on said reflective layer;

an emitter layer on said insulating layer;

etching a well through said deposited emitter and insulating layers to expose said at least one reflective layer such that said emitter layer has at least one edge that extends into said well;

depositing on a transparent substrate;

a transparent layer having a high electrical conductivity;

at least one phosphor layer; and aligning and electrically isolating said second transparent substrate and said first substrate wherein said at least one phosphor layer is oppositely positioned to said at least one reflective layer.

27. The method as recited in claim 26, wherein the step of depositing said emitter layer comprises the steps of:

depositing a conductive layer on said insulating layer;

depositing a resistive layer on said conductive layer, wherein said resistive layer is an alpha-carbon and in electrical contact with said conductive layer.

28. The method as recited in claim 27, further comprising the step of:

depositing a conductive layer between said reflective layer and said first substrate.

29. The method as recited in claim 26, wherein said reflective layer is selected from the group consisting of: gold, silver, aluminum, copper, chromium, niobium, vanadium, molybdenum.

30. The method are recited in claim 27, wherein said conductive layer is selected from the group consisting of: gold, silver, aluminum, copper, chromium, niobium, vanadium, molybdenum.

31. The pixel as recited in claim 5, further comprising:

a second resistive material imposed between said conductive layer and said resistive layer.

32. The pixel as recited in claim 31, wherein said resistive layer is an alpha-silicon material.

33. The system as recited in claim 22, further comprising:

a second resistive material imposed between said conductive layer and said resistive layer.

34. The system as recited in claim 23, wherein said resistive layer is an alpha-silicon material.

35. The method as recited in claim 26, further comprising the step of:

depositing a second resistive layer between said conductive layer and said resistive layer.

36. The method as recited in claim 35, wherein said second resistive layer is an alpha-silicon material.

37. A reflective emission pixel comprising:

a substrate layer;

at least one reflective layer;

a connectivity layer associated with each of said at least one reflective layer, said connectivity layer positioned between said at least one reflective layer and said substrate layer.

an emitter layer positioned on said substrate layer having an edge for electron emission extending above at least one reflective layer, wherein said at least one reflective layer is at a first positive potential to attract electrons from said emitter layer;

a transparent electrode layer oppositely positioned, and electrically isolated from, said at least one emitter layer, said transparent electrode layer having a second potential to attract electrons reflected from said at least one reflective layer; and at least on phosphor layer on said transparent electrode layer oppositely positioned to said at least one reflective layer.

38. The pixel as recited in claim 37, wherein said connectivity layer is selected from the group consisting of: chromium, niobium, vanadium, aluminum, molybdenum, gold, silver, copper.

39. The pixel as recited in claim 37, wherein said reflective layer is selected from the group consisting of: aluminum, chromium, niobium, vanadium, gold, silver, copper.

40. The pixel as recited in claim 37, wherein said emitter layer further comprising:

a conductive layer; and a resistive layer in electrical contact with said conductive layer.

41. The pixel as recited in claim 40, wherein said resistive layer is an alpha-carbon material.

42. The pixel as recited in claim 37, wherein said at least one phosphor layer is selected from a group of phosphors that emits a distinct wavelength when activated.

43. The pixel as recited in claim 42, wherein said distinct wavelength is selected from the group consisting of: red, green, blue.

44. The pixel as recited in claim 37, wherein said emitter layer is distributed within said pixel to increase the edge of the emitter layer.

45. The pixel as recited in claim 37, wherein said emitter layer and said at least one reflective layer are each subdivided into a plurality of digits.

46. The pixel as recited in claim 45, wherein said emitter layer digits and said at least one reflective layer digits are interlockingly positioned.

47. The pixel as recited in claim 37, wherein said second potential is selectively applied to selected areas of said transparent electrode layer.

48. The pixel as recited in claim 37, wherein said fist potential includes a known constant potential and a potential applied as a pluse.

49. The pixel as recited in claim 47, wherein said second potential is applied sequentially to said selected areas.

50. The pixel as recited in claim 49, wherein said second potential is applied for a known duration.

51. A reflective emission pixel comprising:

a substrate layer;

at least one reflective layer;

an emitter layer positioned on said substrate layer having an edge for electron emission extending above said at least one reflective layer;

means to apply a first potential to said at least one reflective layer, wherein said first positive potential operates to attract electrons from said emitter layer a transparent electrode layer oppositely positioned, and electrically isolated from, said at least one emitter layer;

means to apply a second potential to said transparent layer, wherein second potential is operable to attract electrons reflected from said at least one reflective layer; and at least one phosphor layer on said transparent electrode layer oppositely positioned to said at least one reflective layer.

52. The pixel as recited in claim 51, further comprising:

a connectivity layer associated with each of said at least one reflective layer, said connectivity layer positioned between said at least one reflective layer and said substrate layer.

* * * * *